US009449804B2

(12) United States Patent
Bertsch et al.

(10) Patent No.: US 9,449,804 B2
(45) Date of Patent: Sep. 20, 2016

(54) DUAL FIELD MULTIPOLE CONVERGING ION GUIDES, HYPERBOLIC ION GUIDES, AND RELATED METHODS

(71) Applicant: Agilent Technologies, Inc., Santa Clara, CA (US)

(72) Inventors: James L. Bertsch, Santa Clara, CA (US); Kenneth R. Newton, Santa Clara, CA (US); Layne Howard, Santa Clara, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 14/538,382

(22) Filed: Nov. 11, 2014

(65) Prior Publication Data

US 2016/0133452 A1 May 12, 2016

(51) Int. Cl.
*H01J 49/26* (2006.01)
*H01J 49/06* (2006.01)

(52) U.S. Cl.
CPC ..... *H01J 49/063* (2013.01); *H01J 49/068* (2013.01)

(58) Field of Classification Search
USPC ..... 250/281, 282, 283
See application file for complete search history.

(56) References Cited

U.S. PATENT DOCUMENTS

| | | | | |
|---|---|---|---|---|
| 6,674,071 | B2 | 1/2004 | Franzen et al. | |
| 7,276,688 | B2 | 10/2007 | Weiss | |
| 7,507,955 | B2 | 3/2009 | Crawford et al. | |
| 7,569,811 | B2 | 8/2009 | Javahery et al. | |
| 7,868,289 | B2 | 1/2011 | Cousins et al. | |
| 7,872,228 | B1 * | 1/2011 | Kim et al. | H01J 49/423 250/287 |
| 8,124,930 | B2 | 2/2012 | Wang | |
| 8,193,489 | B2 | 6/2012 | Bertsch et al. | |
| 8,637,816 | B1 | 1/2014 | Mordehai et al. | |
| 2012/0248307 | A1 * | 10/2012 | Ding | H01J 49/423 250/293 |

OTHER PUBLICATIONS

A.N. Konenkov, et al.; "Spatial harmonics of linear multipoles with round electrodes"; International Journal of Mass Spectrometry 289 (2010) 144-149.

* cited by examiner

*Primary Examiner* — Nicole Ippolito

(57) ABSTRACT

An ion guide generates a first RF field of Nth order where N is an integer equal to or greater than 2, and a second RF field of 2Nth order superimposed on the first RF field. The first and second RF fields may be generated by respective first and second sets of electrodes. Another ion guide may include a converging entrance section followed by an exit section. The converging section may have a hyperbolic profile. A hyperbolic profile may be presented by electrodes having a twisted configuration relative to an ion guide axis.

20 Claims, 9 Drawing Sheets

DUAL FIELD MULTIPOLE CONVERGING ION GUIDES, HYPERBOLIC ION GUIDES, AND RELATED METHODS

TECHNICAL FIELD

The present invention relates to ion guides such as may be utilized in mass spectrometry systems.

BACKGROUND

A mass spectrometry (MS) system in general includes an ion source for ionizing molecules of a sample of interest, followed by one or more ion processing devices providing various functions, followed by a mass analyzer for separating ions based on their differing mass-to-charge ratios (or m/z ratios, or more simply "masses"), followed by an ion detector at which the mass-sorted ions arrive. An MS analysis produces a mass spectrum, which is a series of peaks indicative of the relative abundances of detected ions as a function of their m/z ratios.

Gas filled ion guides are an example of ion processing devices positioned in the process flow between the ion source and the mass analyzer. A gas filled ion guide may be positioned near the ion source, where the ion guide may transport ions through one or more pressure-reducing stages that successively lower the gas pressure down to the very low operating pressure (high vacuum) of the analyzer portion of the system. A gas filled ion guide may also be positioned in a collision cell, where the ion guide may function as the collision cell or may be used to reduce the beam dimensions for a later stage of the system. In both cases, the ion guide serves multiple functions: a) transport the ions through a region containing a gas with few ion losses, b) transport the ions through a vacuum stage (pressure reducing) wall, c) reduce the emittance of the ion beam (obtain a smaller product of beam cross section and divergence), and d) accomplish all of the foregoing functions over close to the full mass range of the instrument.

A number of existing designs are available that accomplish many of these goals reasonably well. However, an ongoing need exists for further improvements in the design and performance of ion guides. For example, it would be desirable to make improvements in ion transmission over wider mass ranges and/or with larger pressure reductions than is possible with current designs. It would also be desirable to reduce the cost of the current ion guides or the systems containing them.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one embodiment, an ion guide includes: an entrance end; an exit end at a distance from the entrance end along a guide axis; a first RF field generator configured for generating a first RF field of Nth order where N is an integer equal to or greater than 2, the first RF field generator comprising a plurality of first electrodes elongated along the guide axis and circumferentially spaced about the guide axis, wherein the first electrodes surround a guide volume between the entrance end and the exit end; and a second RF field generator configured for generating a second RF field of 2Nth order superimposed on the first RF field and penetrating between the first electrodes, the second RF field generator comprising one or more second electrodes.

According to another embodiment, an ion guide includes: an entrance end; an exit end at a distance from the entrance end along a guide axis; and a plurality of electrodes extending from the entrance end to the exit end and circumferentially spaced about the guide axis, the plurality of electrodes comprising a hyperbolic configuration such that the electrodes inscribe a guide volume from the entrance end to the exit end having a hyperbolic radial boundary swept about the guide axis.

According to another embodiment, an ion guide includes: an entrance end; an exit end at a distance from the entrance end along a guide axis; and a plurality of electrodes extending from the entrance end to the exit end and circumferentially spaced about the guide axis, the plurality of electrodes oriented at a twist angle about the guide axis wherein the electrodes inscribe a guide volume from the entrance end to the exit end having a hyperbolic radial boundary swept about the guide axis.

According to another embodiment, a method for concentrating an ion beam includes: transmitting the ion beam through an ion guide comprising an entrance end, an exit end at a distance from the entrance end along a guide axis, and a plurality of multipole electrodes surrounding a guide volume between the entrance end and the exit end; while transmitting the ion beam, applying a first RF field of Nth order to the ion beam, where N is an integer equal to or greater than 2; and applying a second RF field of 2Nth order to the ion beam, wherein the second RF field is superimposed on the first RF field and penetrates between the multipole electrodes.

According to another embodiment, a method for concentrating an ion beam includes: transmitting the ion beam through an ion guide comprising an entrance end, an exit end at a distance from the entrance end along a guide axis, and a plurality of electrodes extending from the entrance end to the exit end and circumferentially spaced about the guide axis, the plurality of electrodes comprising a hyperbolic configuration such that the electrodes inscribe a guide volume from the entrance end to the exit end having a hyperbolic radial boundary swept about the guide axis; and while transmitting the ion beam, applying a radial RF confining field to the ion beam.

According to another embodiment, a method for concentrating an ion beam includes: transmitting the ion beam through an ion guide comprising an entrance end, an exit end at a distance from the entrance end along a guide axis, and a plurality of electrodes extending from the entrance end to the exit end and circumferentially spaced about the guide axis, the plurality of electrodes oriented at a twist angle about the guide axis wherein the electrodes inscribe a guide volume from the entrance end to the exit end having a hyperbolic radial boundary swept about the guide axis; and while transmitting the ion beam, applying a radial RF confining field to the ion beam.

According to another embodiment, a mass spectrometry system is configured for performing any of the methods disclosed herein.

According to another embodiment, a mass spectrometry system includes: an ion source and/or an ion detector; and an ion guide according to any of the embodiments disclosed herein.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
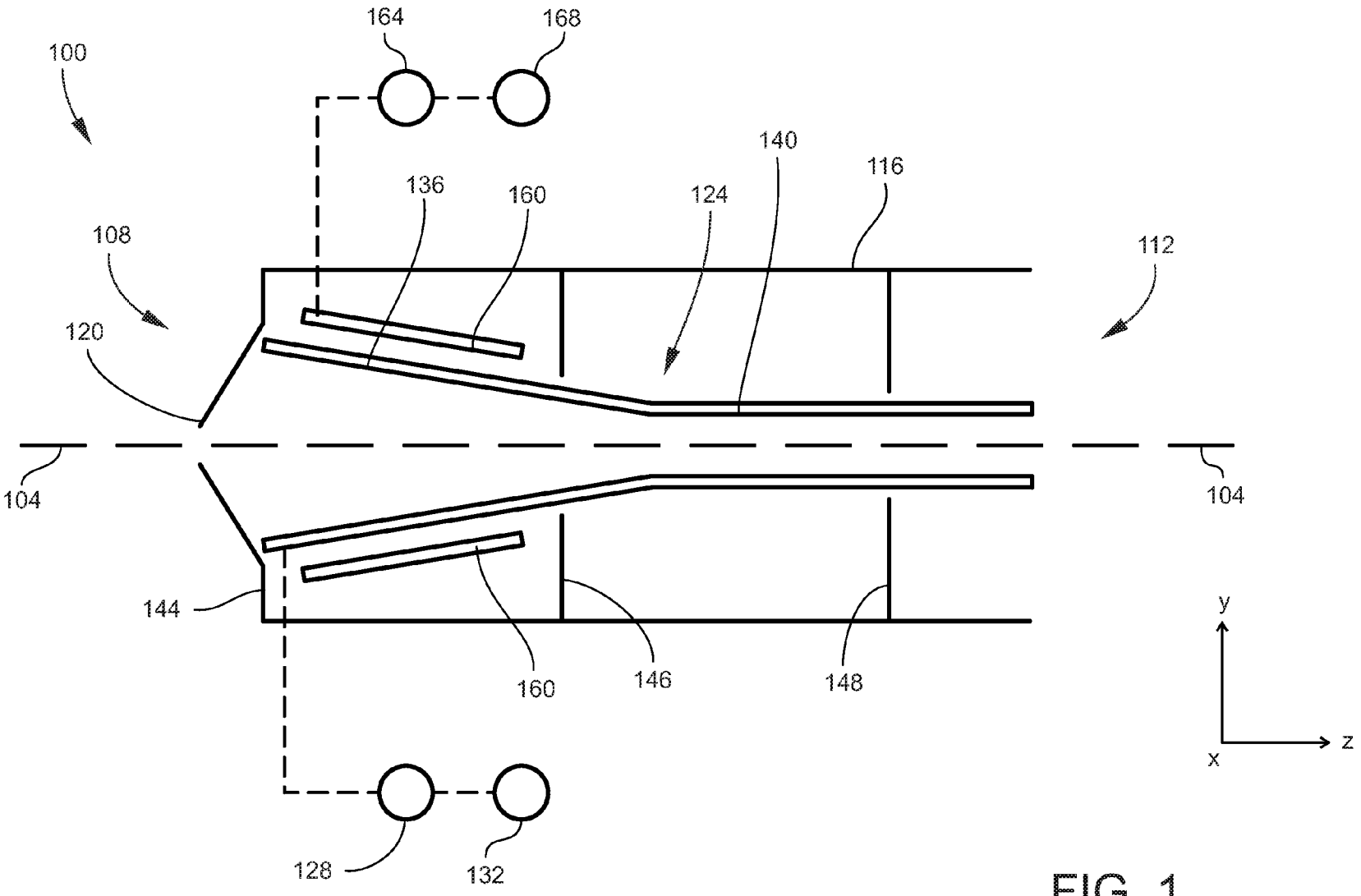
FIG. 1 is a schematic side (length-wise) view of an example of an ion guide according to some embodiments.

FIG. 1 is a schematic side (length-wise) view of an example of an ion guide 100 according to some embodiments. The ion guide 100 generally has a length along a longitudinal axis, or ion guide axis 104, and a transverse cross-section in the transverse plane orthogonal to the ion guide axis 104. The geometry of one or more components of the ion guide 100 may be symmetrical about the ion guide axis 104, in which case the ion guide axis 104 may be considered to be a central axis. For reference purposes, FIG. 1 provides a Cartesian coordinate system in which the z-axis corresponds to the ion guide axis 104 and the cross-section of the ion guide 100 lies in the transverse x-y plane. From the perspective of FIG. 1, resultant ion travel is directed from the left to the right generally along the ion guide axis 104 which may be considered as the ion optical axis.

The ion guide 100 generally includes an ion entrance end 108, an ion exit end 112 disposed at a distance from the ion entrance end 108 along the ion guide axis 104, and a housing 116 enclosing internal components of the ion guide 100 between the ion entrance end 108 and the ion exit end 112. Ions are received at the ion entrance end 108 from an upstream device such as, for example, an ion source, an upstream ion guide, an ion trap, a mass filter, an ion fragmentation device, etc. For this purpose, the ion entrance end 108 may include a gas conductance limiting aperture on the ion guide axis 104, and may further include associated ion optics as appreciated by persons skilled in the art. In the illustrated example, a skimmer plate 120 (also referred to as a skimmer cone or sampling cone) is mounted on the housing 116 in alignment with the aperture of the ion entrance end 108, which assists in preventing unwanted neutral molecules from entering the ion guide 100. Ions are emitted from the ion exit end 112 into a downstream device such as, for example, a downstream ion guide, an ion trap, a mass filter, an ion fragmentation device, an ion beam cooler, a mass analyzer, etc. For this purpose, the ion exit end 112 may include a gas conductance limiting aperture on the longitudinal axis 104, and may further include associated ion optics.

The ion guide 100 is configured for radially confining ions to an ion beam concentrated along the ion guide axis 104. That is, the ion guide 100 is configured for constraining the motions of the ions in the radial directions (in the transverse, x-y plane in FIG. 1) while allowing the ions to flow axially through the ion guide 100. The ion guide 100 is also configured for concentrating the ion beam, i.e., converging the volume occupied by the ion phase space. In this manner, the ion beam has a relatively large beam acceptance (admittance) at the ion entrance end 108 that maximizes ion collection from the preceding ion processing device, and has a relatively small beam emittance at the ion exit end 112 that maximizes ion transmission into the succeeding ion processing device. As a result, the ion guide 100 is configured for transmitting ions through the ion guide 100 in a manner that minimizes loss of ions. In some embodiments, the ion guide 100 may also be configured for axially accelerating the ions as they travel through the ion guide 100 to prevent stalling and/or, in further embodiments, to facilitate ion fragmentation. Alternatively or additionally, ion optics positioned at (at or proximate to) the ion entrance end 108 and the ion exit end 112 may be configured for this purpose, as appreciated by persons skilled in the art. In some embodiments, the ion guide 100 may be configured for reducing the kinetic energy of the ions, i.e., cooling or "thermalizing" the ions, in which case an inert buffer gas (e.g., nitrogen, argon, etc.) may be utilized in the ion guide 100 suitable for cooling. In some embodiments entailing tandem mass spectrometry, the ion guide 100 may be configured for fragmenting the (precursor, or "parent") ions to produce fragment (product, or "daughter") ions, in which case an inert buffer gas (e.g., nitrogen, argon, etc.) may be utilized in the ion guide 100 at a pressure appropriate for collision induced dissociation (CID).

In some embodiments, the ion guide 100 includes a first RF field generator configured for generating a two-dimensional, multipole RF radial confining field (first RF field) of Nth order, where N is an integer equal to or greater than 2. Examples of Nth order RF fields include, but are not limited to, quadrupole (N=2), hexapole (N=3), and octopole (N=4) fields. Thus, the first RF field generator may include a linear (two-dimensional) multipole arrangement of electrodes. More specifically, the first RF field generator may include a plurality of first electrodes 124 elongated along the ion guide axis 104 and circumferentially spaced about the ion guide axis 104, thereby surrounding an axially elongated ion guide volume in which ions may be radially confined. For simplicity, FIG. 1 illustrates only one opposing pair of first electrodes 124 with the understanding that one or more additional opposing electrode pairs are typically provided.

The ion guide 100 also includes an RF voltage source communicating with the first electrodes 124, as schematically depicted as a first RF voltage source 128. In some embodiments, the RF voltage source (e.g., the first RF voltage source 128) may be considered as being a part of the first RF field generator. The first RF voltage source 128 applies a first RF voltage to the first electrodes 124, which in response generate the first RF field in the ion guide volume. The parameters of the first RF voltage (RF drive frequency Ω, amplitude $V_{RF}$, and phase ϕ) are selected such that ions of a desired mass range (m/z range) are radially confined in the ion guide volume in a stable manner. In some embodiments, the mass range over which the radial motions of the ions are stable in the guide volume is made to be as broad as possible. Generally, the RF drive frequency Ω and the amplitude $V_{RF}$ scales with the desired mass range and with the minimum enclosed diameter of the ion guide volume. As one non-limiting example, the RF drive frequency Ω may be 9 MHz and the zero-to-peak amplitude $V_{RF}$ may be about 110 V for a minimum enclosed diameter of about 2.3 mm and a mass range from about 50 Da to about 3000 Da. In some embodiments, a direct current (DC) voltage $U_{DC}$ of desired magnitude may be superimposed on the first RF voltage such that the first RF field is a composite RF/DC field, which may be done to tailor the stable mass range as desired, as appreciated by persons skilled in the art.

The ion guide 100 may also include a DC voltage source communicating with the first electrodes 124, as schematically depicted as a first DC voltage source 132. The DC voltage source 132 may apply a first DC voltage $V_{DC}$ to the first electrodes 124 in a manner that generates an axial DC potential gradient, thereby ensuring that ions continue to drift in the forward direction, even after losing kinetic energy to multiple collisions with a buffer gas. It will be noted that the axial DC potential gradient is separate and distinct from the above-mentioned DC voltage $U_{DC}$ that may be added as part of the two-dimensional, radial confining field.

The number of first electrodes 124 utilized may correspond to the number of poles in the first RF field generated by the first electrodes 124. Thus, for example, four electrodes may generate a quadrupole field, six electrodes may generate a hexapole field, eight electrodes may generate an octopole field, etc. Each first electrode 124, being appreciably elongated along one axis in comparison to its cross-section in the plane transverse to that axis, may be considered as being rod-shaped and thus may be referred to as a rod. In practice, a pure or ideal multipole field of the desired order is not achievable due to the necessarily finite dimensions of the rods. In some embodiments, the cross-section of each rod may be curved. That is, each rod, or at least the part of its surface facing the guide interior, may be provided with an engineered profile that enhances the purity of the multipole field. For example, the cross-section of each rod may present a hyperbolic surface facing the guide interior. However, due to the fact that the hyperbolic surface is physically truncated, the resulting multipole field is still not ideal in that one or more higher-order fields may be superimposed on the desired multipole field, although such inherently generated higher-order fields have negligible influence on ion motion. In some embodiments, the rods may be shaped as straight cylinders (cylindrical with circular cross-sections), which may represent a trade-off between manufacturing cost and the degree of field purity achieved. In other embodiments, the rods may be polygonal, e.g., bar-shaped.

In some embodiments, the first electrodes 124 may be considered as including an ion entrance section 136 and an ion exit section 140 extending along the ion guide axis 104. The ion entrance section 136 extends from the ion entrance end 108 and transitions to the ion exit section 140, and the ion exit section 140 extends to the ion exit end 112. In the ion entrance section 136, the set of first electrodes 124 has a converging (conical) geometry. Thus in the ion entrance section 136, the first electrodes 124 are oriented in directions pointed toward the ion guide axis 104 such that in the direction toward the ion exit end 112, the cross-sectional area of the guide volume surrounded by the first electrodes 124 and the circumferential spacing between adjacent first electrodes 124 are reduced. In the ion exit section 140, the set of first electrodes 124 may have a straight or substantially geometry in which each first electrode 124 is parallel or substantially parallel to the guide axis 104. In some embodiments the ion exit section 140 may be diverging, or a portion of the ion exit section 140 may be diverging such as at the ion exit end 112. Thus, the guide volume is conical in the ion entrance section 136 and cylindrical, substantially cylindrical, diverging, or partially diverging in the ion exit section 140. In the ion entrance section 136, the first RF field concentrates the ion beam due to the converging geometry of the first electrodes 124. Consequently, the beam emittance is reduced from a maximum at the ion entrance end 108 to a minimum at the transition from the converging geometry to the straight geometry. In the ion exit section 140, the first RF field may largely preserve the reduced emittance of the ion beam up to the ion exit end 112.

The first electrodes 124 generally may extend along the guide axis 104 from the ion entrance end 108 to the ion exit end 112. Depending on the embodiment, the ion entrance end 108 may correspond to an end of the housing 116, an end of the first electrodes 124, or both (i.e., the ends of the housing 116 and the first electrodes 124 may be generally at the same axial position). Likewise, the ion exit end 112 may correspond to an opposite end of the housing 116, an opposite end of the first electrodes 124, or both. The first electrodes 124 may be assembled, aligned, and mounted in the ion guide 100, and coupled to electronics, according to any suitable techniques now known or later developed.

The axial length of the ion entrance section 136 may be the same as or different from that of the ion exit section 140. In some embodiments, the axial length of the ion exit section 140 may be selected in view of facilitating a specific function such as, for example, ion cooling, pressure reducing, etc.

In some embodiments, the ion guide 100 may include one or more vacuum chambers (pressure-reducing stages) through which the first electrodes 124 extend. The housing 116 is structured to enclose and define the vacuum chamber (s) in a fluid-sealed manner. In the illustrated embodiment, the ion guide 100 includes a first vacuum chamber defined between a first transverse wall 144 and a second transverse wall 146 of the housing 116, and a second vacuum chamber defined between the second transverse wall 146 and a third transverse wall 148 of the housing 116. FIG. 1 also partially illustrates a third vacuum chamber to the right of the third transverse wall 148. The third vacuum chamber may be part of the ion guide 100 or may be the input end of another ion processing device such as, for example, a mass filter or mass analyzer. Each vacuum chamber may include a vacuum port (not shown) coupled to a vacuum system that controls the pressure levels in the respective vacuum chambers. For example, each successive vacuum chamber may reduce the gas pressure to a level lower than the preceding chamber. Ultimately, the pressure may be reduced down to the high vacuum level required in the mass analyzer. In some embodiments in which the ion guide 100 is operated as an ion cooler, the first vacuum chamber is held at a gas pressure appropriate for thermalizing the ions without causing fragmentation. In some embodiments in which the ion guide 100 is operated as a collision cell, the first vacuum chamber is held at a relatively higher gas pressure appropriate for CID. In some embodiments, the first vacuum chamber is operated as a collision cell and the second vacuum chamber is operated as an ion cooler. For purposes of implementing ion cooling and/or ion fragmentation, one of more of the vacuum chambers may include inlet ports (not shown) for introducing a buffer gas.

In the illustrated embodiment, the first electrodes 124 extend through the first vacuum chamber, the second vacuum chamber, and into the third vacuum chamber. Each of the transverse walls 144, 146, and 148 has an aperture sized to minimize gas conductance yet at the same time accommodate passage of the first electrodes 124 through the aperture.

In other embodiments, in which the ion guide 100 is located in a single vacuum chamber, ion guide 100 may be configured to provide a pressure gradient along the guide axis.

Figure 2A:
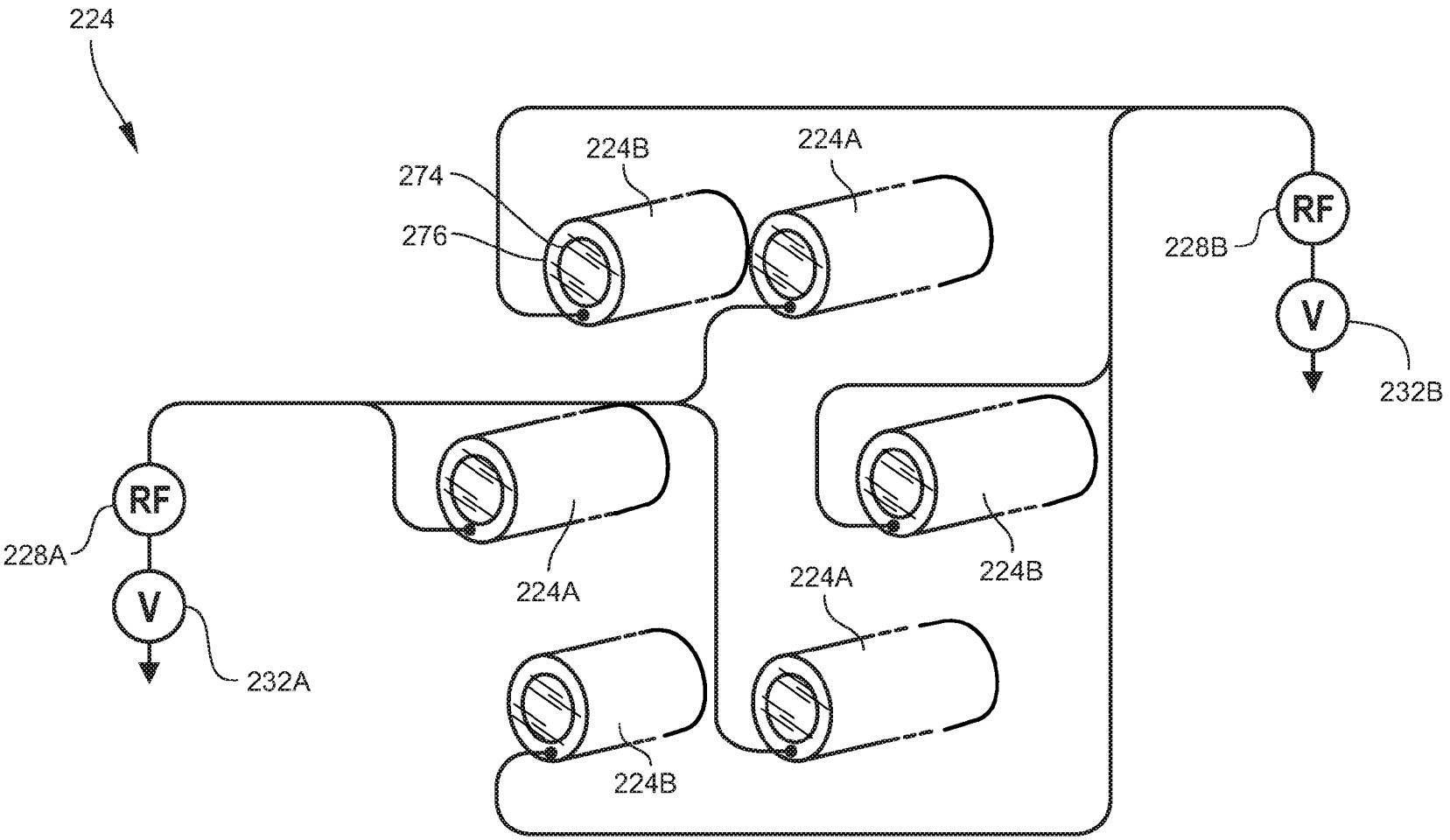
FIG. 2A is a perspective view of one end (entrance or exit) of an example of a set of first electrodes according to some embodiments.

FIG. 2A is a perspective view of one end (entrance or exit) of a set of first electrodes 224 according to some embodiments. FIG. 2A illustrates six first electrodes 224 (a hexapole arrangement) by example only, with the understanding that less than six or more than six first electrodes 224 may be provided. In a typical embodiment, a two-phase first RF voltage of the general form $V_{RF}\cos(\Omega t)$ is applied to the first electrodes 224 such that the signal applied to a given electrode is 180 degrees out of phase with the signal applied to the adjacent electrodes on either side that given electrode. In FIG. 2A, this is schematically depicted by the first electrodes 224 including electrodes 224A (e.g., first, third, and fifth electrodes) electrically interconnected to each other, and electrodes 224B (e.g., second, fourth, and sixth electrodes) electrically interconnected to each other. Each electrode 224A (or 224B) is adjacent to two electrodes 224B (or 2224A) on either side as one moves around the guide axis, i.e., electrodes 224A and 224B are alternately positioned around the guide axis. The first RF voltage source is schematically depicted as an RF voltage source 228A applying the first RF voltage to the electrodes 224A at a first phase, and an RF voltage source 228B applying the first RF voltage to the other electrodes 224B at a second phase shifted 180 degrees from the first phase.

As also shown in FIG. 2A, in some embodiments each first electrode 224 may include an electrically insulating element 274 (e.g., core) and an outer electrically resistive element 276 (e.g., layer or coating) surrounding the insulating element 274. The insulating element 274 may be composed of, for example, an insulating polymer, a ceramic, or an insulating oxide compound. The resistive element 276 may be composed of, for example, a resistive ink, a metallic oxide, a metal, a metal alloy, graphite, or a conductive polymer. The RF voltage sources 228A and 228B are placed in signal communication with the resistive elements 276. The resistive element 276 may be fabricated as a layer exhibiting extremely uniform resistance to provide a substantially homogeneous axial DC voltage gradient along the length of all first electrodes 224. The DC gradient may be generated by applying DC voltages to the opposing ends of the resistive element 276, instead of requiring the use of separate electrostatic lenses at the entrance and exit or separate electrode segments at the entrance and exit. The first DC source is schematically depicted as a DC source 232A applying the first DC voltage to the electrodes 224A, and a DC source 232B applying the first DC voltage to the other electrodes 224B. In some embodiments, the amplitude of the applied RF voltage is the same for all first electrodes 224, and the magnitudes of the applied DC voltages is the same for all first electrodes 224 at one end or the other.

Figure 2B:
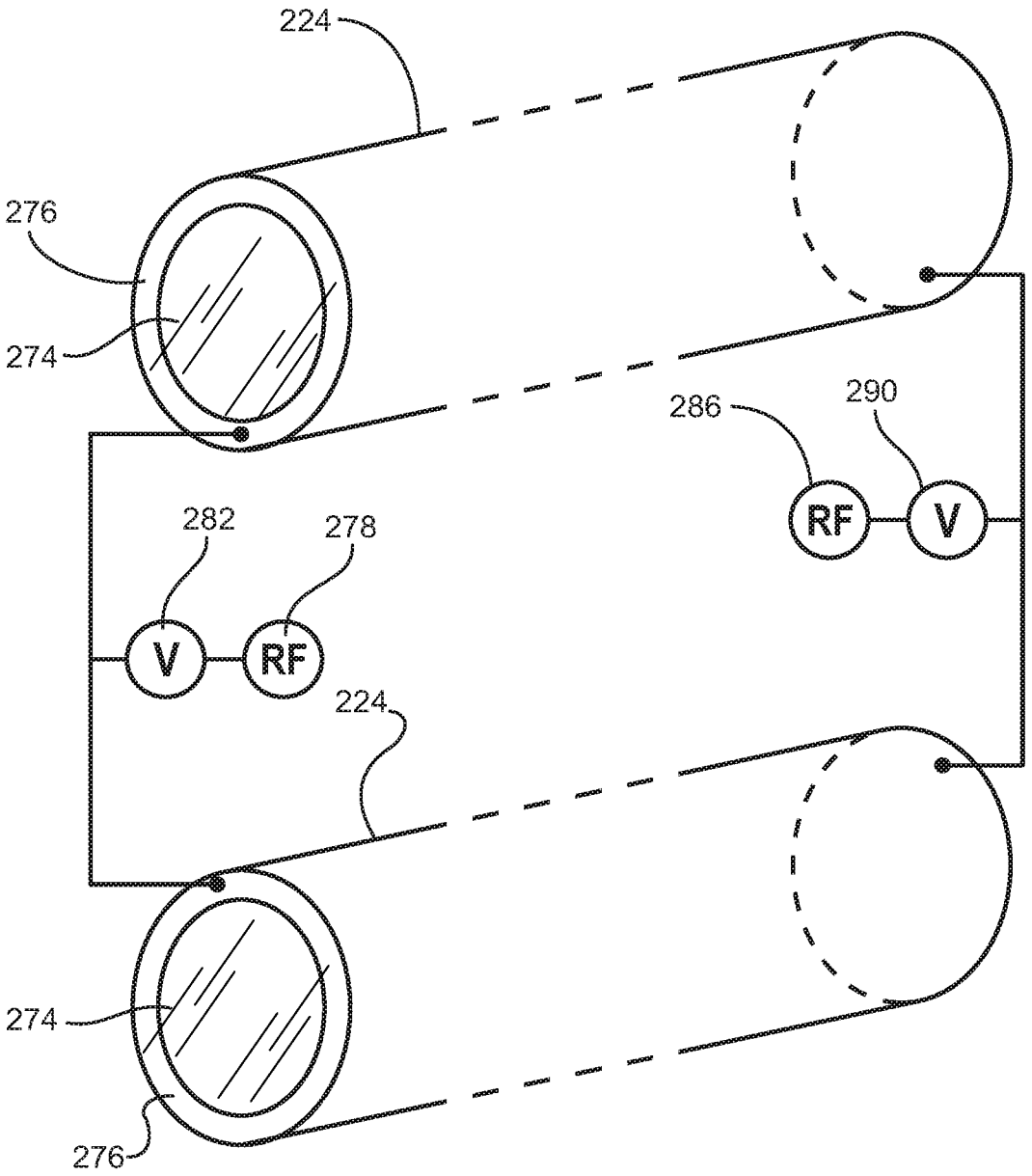
FIG. 2B is a perspective view of two of the first electrodes illustrated in FIG. 2A that are electrically interconnected.

FIG. 2B is a perspective view of two of the first electrodes 224 that are electrically interconnected. FIG. 2B schematically illustrates RF voltage sources 278 and 286 and DC voltage sources 282 and 290 coupled to opposite ends of the first electrodes 224. Typically, the RF voltages are applied uniformly along the length of each first electrode 224 from end to end. Hence, schematically the RF voltage source 278 may be the same as the RF voltage source 286. The magnitude of the DC voltage 290 applied at the exit end of each first electrode 224, however, may be different than the magnitude of the DC voltage 282 applied at the entrance end so as to generate axial electric field gradient that accelerates the ions as described above. In some embodiments, the RF voltage may be applied only at one end of the first electrodes 224 or at the middle of the first electrodes 224. This may be facilitated, for example, by providing the first electrodes 224 with a three-layer configuration in which the core is a conductive material, which is surrounded by an insulating layer, which in turn is surrounded by an outer resistive layer. An example of a three-layer configuration is described in U.S. Pat. No. 7,064,322, the entire content of which is incorporated by reference herein.

Figure 3A:
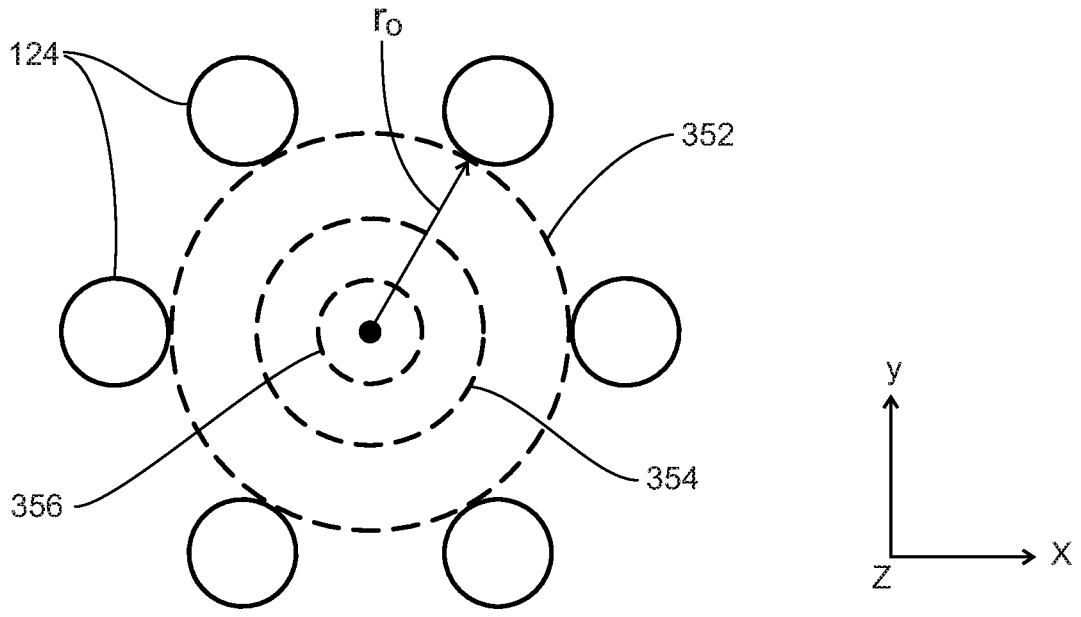
FIG. 3A is a schematic end view (in the transverse plane) of an example of a set of first electrodes and a set of second electrodes at an entrance end according to some embodiments.
Figure 3B:
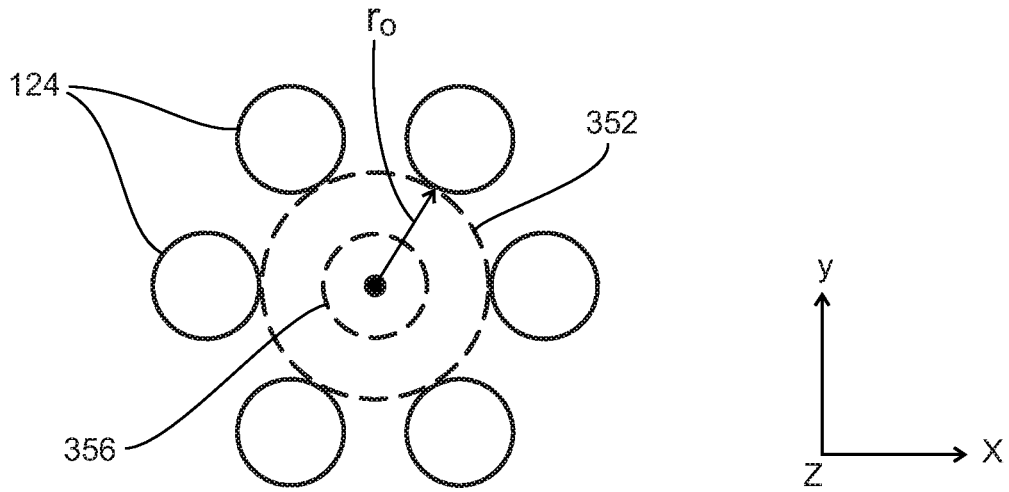
FIG. 3B is a schematic end view (in the transverse plane) of the set of first electrodes illustrated in FIG. 3A at the end of an ion entrance section or at the ion exit end.

FIG. 3A is a schematic end view (in the transverse plane) of the set of first electrodes 124 at the ion entrance end (i.e., the beginning of the ion entrance section 136 shown in FIG. 1). Again, a hexapole arrangement is illustrated by example only. The first electrodes 124 inscribe a guide volume 352 of radius $r_0$. The guide volume 352 generally corresponds to the interior region of the ion guide 100 (FIG. 1) in which stable ions can be confined through application of the two-dimensional RF confining field by the first electrodes 124. The ion acceptance envelope, or beam "diameter" at the ion entrance end, is depicted by a dashed circle 354. In practice, the actual cross-sectional area of the ion beam may have a more elliptical shape, with the orientation of the ellipse varying in the transverse plane in accordance with the periodic cycle of the RF voltage being applied. By comparison, FIG. 3B is a schematic end view (in the transverse plane) of the set of first electrodes 124 at the end of the ion entrance section 136 where the transition to the ion exit section 140 occurs (FIG. 1), or at the ion exit end (i.e., the end of the ion exit section 140). Due to the converging geometry of the ion entrance section 136, the cross-sectional area of the guide volume 352 is reduced (as evident from the smaller radius $r_0$) and the circumferential spacing between adjacent first electrodes 124 is reduced. The RF field generated by the converging ion entrance section 136 compresses or concentrates the ion beam down to a smaller ion emittance envelope, which is depicted by a dashed circle 356 in FIG. 3B and also included in FIG. 3A for comparison with the larger initial beam emittance (or acceptance 354).

The RF voltage applied to the first electrodes 124 creates a pseudo-potential well in the guide volume described by the following equation:

$$V_{psuedo} = 6.64\times10^{-33} n^2 eV^2 \frac{\left(\frac{r}{r_0}\right)^{2n-2}}{m\Omega^2 r_0^2},$$

where n=order of multipole, e=charge of ion in Coulombs, V=RF amplitude in volts, r=radial distance from the guide axis in millimeters (mm), $r_0$=inscribed radius of the multipole electrode set in mm, m=atomic mass of the ion in atomic mass units (amu), and Ω=angular frequency of the applied RF voltage in radians/second (r/s). When a background collision gas is also present, the ions will generally lose energy to the collision gas and settle into trajectories near the lowest pseudo-potential near the guide axis. However, at the low end of the mass range, ions at the same temperature will travel at higher velocities and will travel greater distances in each RF cycle and can exit through the potential barrier as the RF field is constantly changing phase. This is a "low mass instability" and sets the lower limit for mass range in such a device. The stability is a function of $m\Omega^2 r_0^2/V$. The pseudo-potential is reduced as the first electrodes 124 get further separated at the larger end of the converging ion entrance section 136 and ion containment is less efficient. It becomes clear that the mass bandwidth of a converging device is limited by the high mass pseudo-potential at the larger end and the low mass instability at the smaller end. The mass bandwidth could be improved by increasing the RF drive frequency and voltage. However, increasing the frequency beyond about 10 MHz is difficult for structures of useful size for capturing ions that are exiting vacuum inlets or mass filters. Increasing voltage is limited because of voltage breakdown, especially in high gas pressure devices operating where the mean free path is approaching the electrode rod spacing. Increasing frequency increases power, which leads to greater cost, and temperature and reliability issues, and self-resonant limitations in drive transformers.

According to the present teachings, the conflicting limitations on the mass bandwidth may be overcome by applying a second RF voltage at a location of the ion guide 100 such that the second RF voltage penetrates between the gaps between adjacent first electrodes 124. This has the effect of generating a second, higher order RF multipole field (second RF field) that is superimposed on the first RF field. The second RF field is of 2Nth order in comparison to the first RF field. Thus, for example, if the first RF field is a hexapole field the second RF field will be a dodecapole field. Other examples of a composite first RF field/second RF field include, but are not limited to, a quadrupole/octopole field and an octopole/hexadecapole field.

FIG. 1 illustrates an example of implementing the second RF field. The ion guide 100 includes a second RF field generator configured for generating a second RF field of 2Nth order superimposed on the first RF field and penetrating between the first electrodes 124. The second RF field generator includes one or more second electrodes 160 positioned along a portion of or the entire length of the ion entrance section 136. The second electrode(s) 160 may be provided in the form of a single electrode, or as a plurality of electrodes elongated along the guide axis 104 and circumferentially spaced from each other similar to the first electrodes 124. Alternatively, the second electrode(s) 160 may have other configurations as described by example below.

The second electrode(s) 160 may be positioned outside of (and thus surround) the first electrodes 124, in which case the second electrode(s) 160 may be referred to as outer electrodes and the first electrodes 124 may be referred to as inner electrodes. In other embodiments, the second electrodes 160 may be positioned in the gaps between respective pairs of adjacent first electrodes 124. In other embodiments, the second electrodes 160 may be partially outside the first electrodes 124 but extend into or through the gaps between the first electrodes 124.

The RF voltage source of the ion guide 100 includes a second RF voltage source 164 communicating with the second electrode(s) 160. In some embodiments, the RF voltage source (e.g., the second RF voltage source 164) may be considered as being a part of the second RF field generator. The second RF voltage source 164 applies a second RF voltage of the general form $V_{RF}\cos(\omega t)$ to the second electrode(s) 160, which in response generates the second RF field that penetrates the envelope of the first electrodes 124 and into the guide volume. In some embodiments, the second RF voltage is a single-phase RF potential. The second RF voltage may be applied at any phase relative to the phases at which the first RF voltage is applied.

The DC voltage source of the ion guide 100 may also include a second DC voltage source 168 communicating with the second electrode(s) 160. In some embodiments, the second electrode(s) 160 may have a composite insulating/resistive configuration similar to the embodiment of the first electrodes 124 described above and illustrated in FIGS. 2A and 2B. In operation, it may be desirable for the DC potential on the second electrode(s) 160 to be set about the same as DC potential on the first electrodes 124 at the ion entrance end 108 to minimize the influence of the DC potential on the second electrode(s) 160.

In some embodiments, the second electrode(s) 160 may be arranged outside of first electrodes 124, and in a converging manner similar to the first electrodes 124. Thus, with the first electrodes 124 located at a first radius from the guide axis 104, the second electrode(s) 160 may be located at a second radius from the guide axis 104 that differs from the first radius by some offset value. The offset may remain constant along the guide axis 104, i.e., the angle of convergence of the second electrode(s) 160 may be the same as that of the first electrodes 124. Alternatively, the offset may vary along the guide axis 104, i.e., the angle of convergence of the second electrode(s) 160 may differ from that of the first electrodes 124. The offset may be selected as needed to obtain a desired amount of penetration of the second RF field into the guide volume, while avoiding voltage breakdown (due to Paschen's Law). For example, the offset may be tailored to obtain a desired mass range to be confined by the ion guide 100. Moreover, the offset may be made smaller at the downstream end of the second electrode(s) 160 than at the upstream end, or vice versa. Reducing the offset at the downstream end may be useful, for example, for enhancing the field penetration at the downstream end of the first electrodes 124, in view of the fact that the field penetration is naturally reduced as the spacing between the first electrodes 124 decreases in the downstream direction. In addition, if desired the offset may be increased to achieve more breakdown strength or to allow easier gas escape, although increasing the offset may require increasing the RF voltage to maintain the desired potential in the gaps between the first electrodes 124. Moreover the offset may be adjustable, such as by replacing the second electrode(s) 160 with a differently sized arrangement, or by configuring the mounting hardware in a manner that permits the position(s) of the second electrode(s) 160 to be adjusted.

Appropriate selection of the drive frequency for the second RF field serves to supply a containing field for the portion of the mass range that would have otherwise been lost in the growing gaps between the first electrodes 124. The drive frequency of the second RF field may be set to be less than the drive frequency of the first RF field so that despite its relatively large $2R_0$, the high mass pseudo-potential is still substantial. This is particularly important for operation behind a vacuum inlet such as a skimmer 120, capillary, or orifice where not only does the gas pressure reduce the effective pseudo-potential, but the expanding gas has radial velocity vectors that create an aerodynamic drag force which pushes the ions radially out of the device. This radial gas force must be overcome with an oppositely directed pseudo-potential force. While this pseudo force is, like the pseudo-potential, a statistical construct based on the paths of multiple ions with varying phase space and RF phase, it can be approximated by differentiating the pseudo-potential equation with respect to radius to obtain the effective field, $E_{pseudo}$ (in volts/meter), as follows:

$$E_{psuedo} = \frac{dU}{dr} V_{psuedo} = 1.33\times10^{-32} n^2 \mathrm{eV}^2 \frac{\frac{(n-1)}{r}\left(\frac{r}{r_0}\right)^{2n-2}}{m\Omega^2 r_0^2}$$

For specific multipole configurations $$E_{psuedo} = \frac{dU}{dr} V_{psuedo} = 2.66\times10^{-32} n^2 \mathrm{eV}^2 \frac{r^3}{m\Omega^2 r_0^6} \text{ for hexapole.}$$

$$E_{psuedo} = \frac{dU}{dr} V_{psuedo} = 6.64\times10^{-33} n^2 \mathrm{eV}^2 \frac{r^9}{m\Omega^2 r_0^{12}} \text{ for dodecapole.}$$

The force then is $E_{pseudo}\times e$. The force is equal to zero at the centerline (guide axis), and increases radially.

Because of the superposition of the two RF fields, with different order multipole terms, different voltages, and different frequencies, embodiments of the ion guide 100 disclosed herein may achieve greater beam compression, transmit the full mass range ions produced from a sample, operate at higher pressures, and better tolerate radial gas velocity vectors, as compared with conventional linear multipole ion guides. Moreover, the foregoing may be achieved with lower voltages and power, reducing the cost of the electronics and improving reliability. Furthermore, the foregoing may be achieved with a single inner element, i.e., a single (non-segmented) set of the first electrodes 124, thus avoiding the complications of fringe fields, alignment issues, and the cost of building multiple staged devices. In addition, the ion guide 100 is well-suited for operation as a collision cell as it can accept the large ion phase space that exits a quadrupole mass filter or other preceding device, transmit and collisionally cool parent ions and fragment ions simultaneously, and deliver a much smaller ion phase space then currently achieved into a subsequent mass filtering device such as a quadrupole or time-of-flight (TOF) analyzer. Thus, the ion guide 100 may enable higher overall system transmission, broader mass range transmission, and improved MS and MS-MS spectra.

As noted above, the RF drive frequency Ω and the amplitude $V_{RF}$ scales with the desired mass range and with the minimum enclosed diameter of the ion guide volume. Continuing with the non-limiting example given above for minimum enclosed diameter of about 2.3 mm and a mass range from about 50 Da to about 3000 Da, the drive frequency of the first RF field (first frequency) may be 9 MHz, while the drive frequency of the second RF field (second frequency) may be 1 MHz. In some embodiments, the second frequency is in a range 50% or less of the first frequency. In some embodiments, the zero-to-peak amplitude of the first RF field (first peak amplitude) may be about 110 V, while the zero-to-peak amplitude of the second RF field (second peak amplitude) may be about 250 V. The mass range able to be transmitted by the ion guides disclosed herein will depend on the values selected for the first frequency, the second frequency, the first peak amplitude, and the second peak amplitude. In some embodiments, the ratio of the beam acceptance diameter at the ion entrance to the beam acceptance diameter at the ion exit of the first electrodes attainable by the ion guides disclosed herein may be about 3:1, while in other embodiments may be lower or higher than 3:1.

It will be appreciated by persons skilled in the art that in all embodiments disclosed herein, the second RF field generated by the ion guide is, like the first RF field, intentionally generated through operation of electronics. The second RF field is an intentional higher-order field applied at a field strength sufficient for that higher-order field to have a significant, useful effect on ion confinement and/or ion beam compression. As such, the second RF field is to be distinguished from any unintentional (i.e, inherent, and often unavoidable) higher-order fields that may be generated in the ion guide even in the absence of the second RF field. Examples of unintentional higher-order fields include those generated due to space-charge effects, as well as perturbations (field faults, fringe effects, distortions, etc.) due to practical limitations imposed by the electrodes, such as machining and assembly imperfections, geometric discontinuities, non-ideal shapes, etc. Any such unintentional higher-order fields so generated will be relatively weak in comparison to the second RF field, and often very localized, and will not have an appreciable effect on the ions. As another example of characterizing the second RF field generated by the ion guide, but not limiting to any of the embodiments disclosed herein, the second RF field may have a field strength that is 10% or greater of the field of the first RF field being applied.

Figure 4:
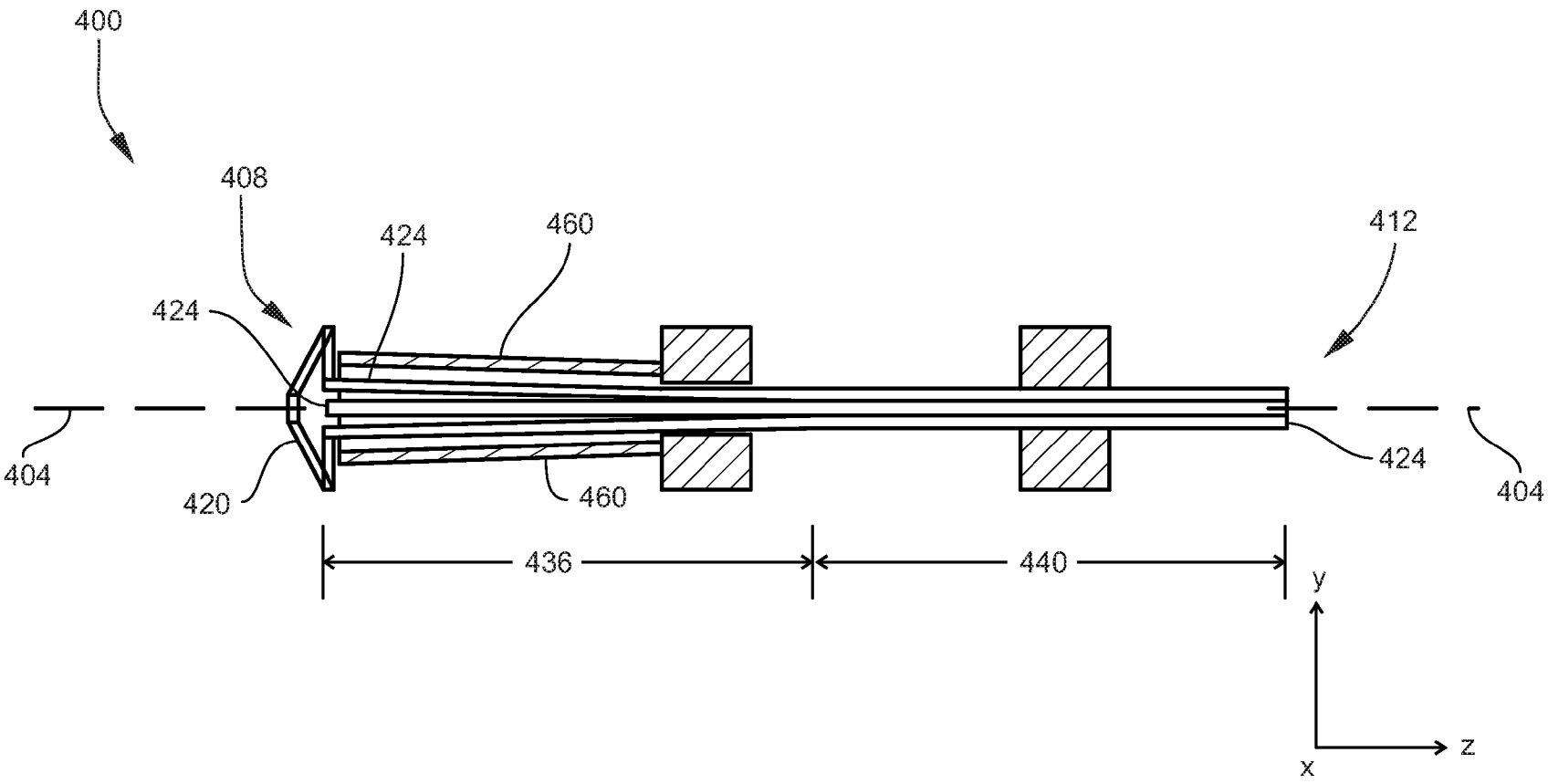
FIG. 4 is a side (length-wise) view of another example of an ion guide according to some embodiments.

FIG. 4 is a side (length-wise) view of another example of an ion guide 400 according to some embodiments. The ion guide 400 generally has a length along an ion guide axis 404, and a transverse cross-section in the transverse plane orthogonal to the ion guide axis 404. The ion guide 400 generally includes an ion entrance end 408 and an ion exit end 412 disposed at a distance from the ion entrance end 408 along the ion guide axis 404. The ion guide 400 may also include a housing (not shown) enclosing internal components of the ion guide 400 between the ion entrance end 408 and the ion exit end 412, as described above. In the illustrated embodiment, a skimmer plate 420 is mounted at the ion entrance end 408.

The ion guide 400 includes a first RF field generator configured for generating a first RF field of Nth order, where N is an integer equal to or greater than 2. In the illustrated embodiment, the first RF field generator includes a plurality of first electrodes 424 elongated along the ion guide axis 104 and circumferentially spaced about the ion guide axis 104, thereby surrounding an axially elongated ion guide volume in which ions may be radially confined. FIG. 4 illustrates a hexapole arrangement (of which three first electrodes 424 are shown) by example only, as other multipole arrangements may be utilized as noted above. RF or RF/DC power may be fed to the first electrodes 424 as described above. The first electrodes 424 may be considered as including an ion entrance section 436 and an ion exit section 440 extending along the ion guide axis 404. The ion entrance section 436 extends from the ion entrance end 408 and transitions to the ion exit section 440, and the ion exit section 440 extends to the ion exit end 412. In the ion entrance section 436, the set of first electrodes 424 has a converging (conical) geometry. In the ion exit section 440, the set of first electrodes 424 has a straight or substantially straight cylindrical geometry. In the illustrated embodiment, the first electrodes 424 are bent so as to define the converging ion entrance section 436 and the straight ion exit section 440. The bends in the first electrodes 424 provide the transition from the ion entrance section 436 to the ion exit section 440.

The ion guide 400 also includes a second RF field generator configured for generating a second RF field of 2Nth order superimposed on the first RF field and penetrating between the first electrodes 424. In the illustrated embodiment, the second RF field generator includes a single second electrode 460 (or outer electrode) surrounding the first electrodes 424 along a portion or the entire length of the ion entrance section 436. The second electrode 460 may be or include a solid wall and, as illustrated, the wall may be conical similar to the ion entrance section 436 of the first electrodes 424. The angle of convergence of the second electrode 460 may be the same as or different from the angle of convergence of the ion entrance section 436 of the first electrodes 424, as described above. Alternatively, the second electrode 460 may have other configurations as described by example below.

According to other embodiments, the converging-to-straight (or substantially straight) geometry of the ion guide electrodes (and consequently of the ion guide volume) may be implemented by arranging, orienting, and/or shaping the ion guide electrodes to have a hyperbolic configuration along the guide axis and facing the guide volume. That is, the set of ion guide electrodes exhibits a hyperbolic profile facing the guide volume when viewed from a side or length-wise perspective, such as in the y-z plane view of FIG. 1 or 4. Consequently, the hyperbolic set of ion guide electrodes in effect inscribes a guide volume having a hyperbolic radial boundary swept about the guide axis. Accordingly, the value for $r_0$ varies as one moves along the guide axis, and corresponds to points on the hyperbolic curve presented by the electrode set. In other words, the hyperbolic radial boundary is defined by spatial coordinates along the guide axis (z-axis) and a radial axis (e.g., y-axis) in a length-wise plane (y-z plane) orthogonal to the transverse plane (x-y plane), and the outer boundary of the guide volume is or approximates the surface of a hyperboloid of revolution about the guide axis.

Figure 5A:
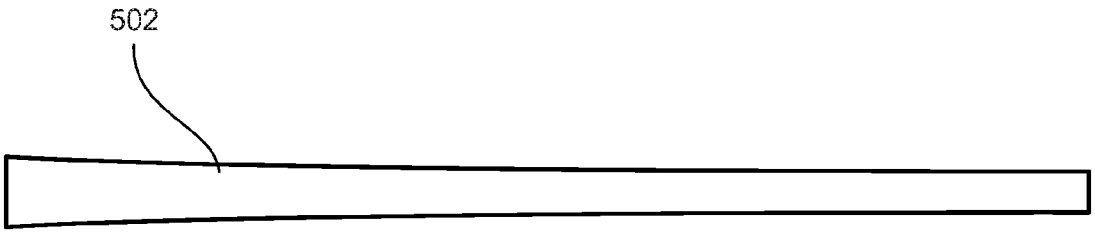
FIG. 5A is a side view (y-z plane) of an example of a guide volume having a hyperbolic radial boundary, as depicted by a hyperbolic surface swept about an ion guide axis, according to some embodiments.
Figure 5B:
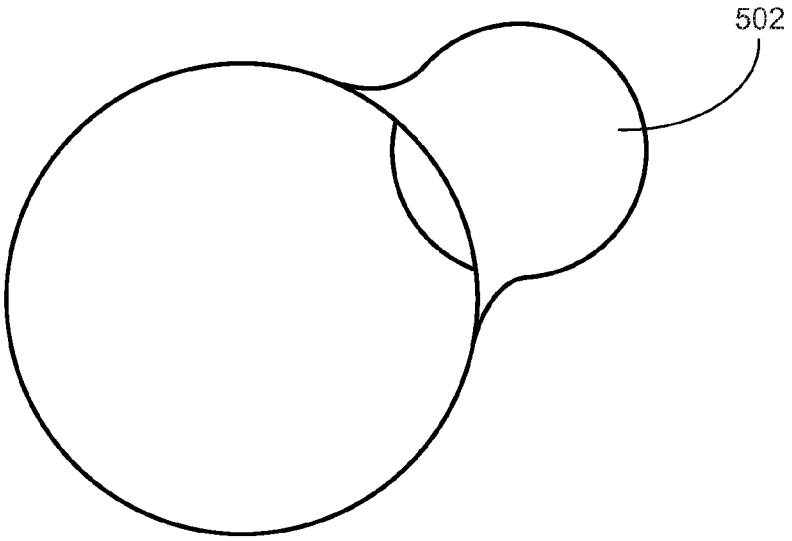
FIG. 5B is a perspective view of the guide volume illustrated in FIG. 5A.

FIG. 5A is a side view (y-z plane) of an example of a guide volume having a hyperbolic radial boundary, as depicted by a hyperbolic surface 502 swept about the guide axis. FIG. 5B is a perspective view of the guide volume illustrated in FIG. 5A. The shape or spread of the hyperbolic curve may be wide, i.e., the eccentricity may be large. The ion guide electrodes inscribing the hyperbolic radial boundary may extend along any portion of the hyperbolic curve, and may or may not include the vertex of the hyperbolic curve. In some embodiments, the hyperbolic configuration of the guide electrodes is such that the guide volume has a minimum radius $r_0$ from the guide axis at an axial point closer to the ion exit end than to the ion entrance end. In some embodiments, the entire length of the electrode set provides the hyperbolic configuration. In other embodiments, a portion of the length of the electrode set provides the hyperbolic configuration and then transitions to a straight cylinder or other shape.

In some embodiments, the hyperbolic configuration is realized by each guide electrode having a hyperbolic curvature along the guide axis, i.e., in the y-z plane of FIG. 1, 4, or 5A. Such guide electrodes may be arranged in a manner similar to the first electrodes 424 shown in FIG. 4, but instead of having distinct bends, the guide electrodes are formed so as to have smooth hyperbolic curvatures.

Figure 6A:
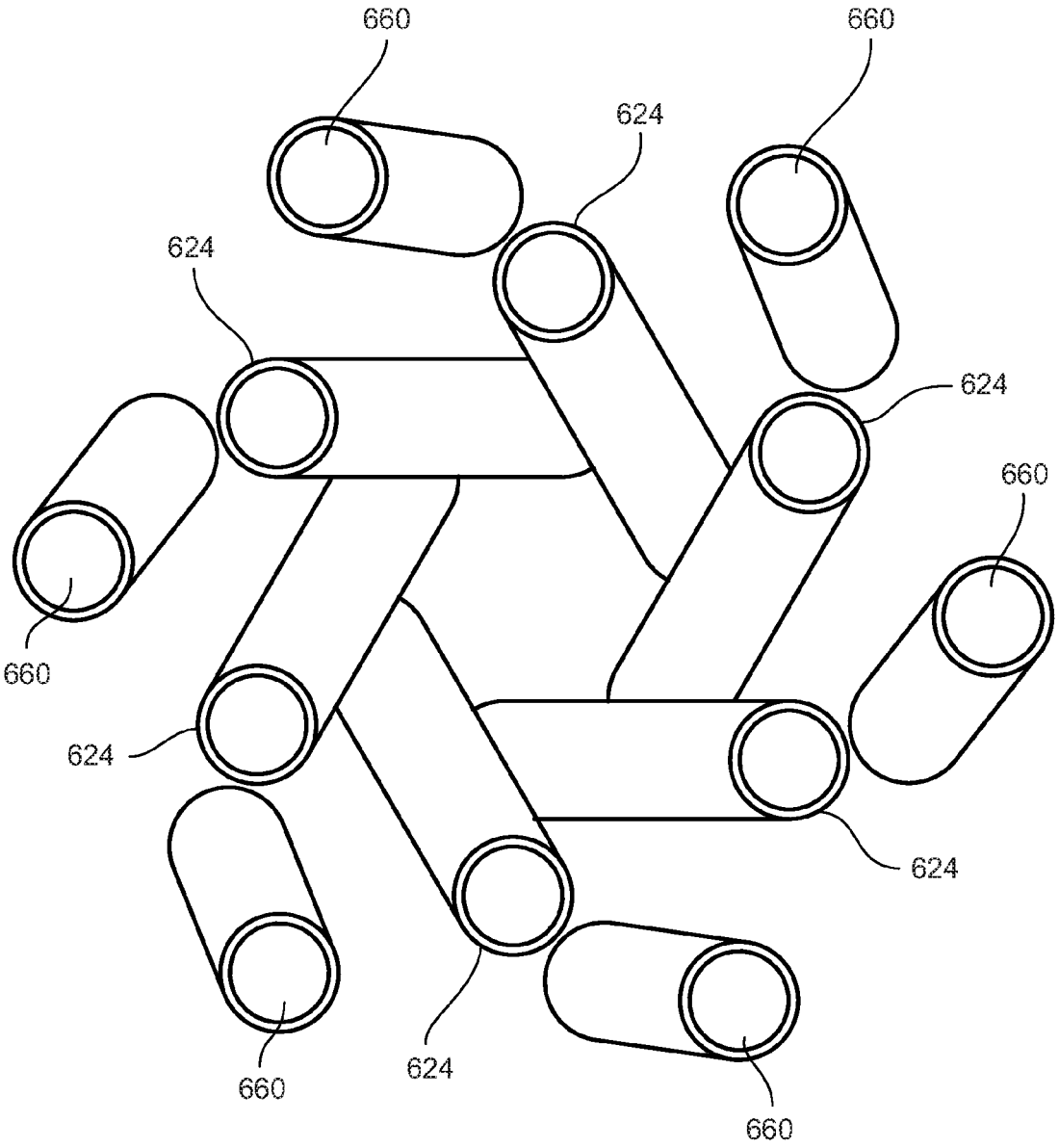
FIG. 6A is an end view (in the transverse plane) of an example of a set of first electrodes at an ion entrance end according to some embodiments.
Figure 6B:
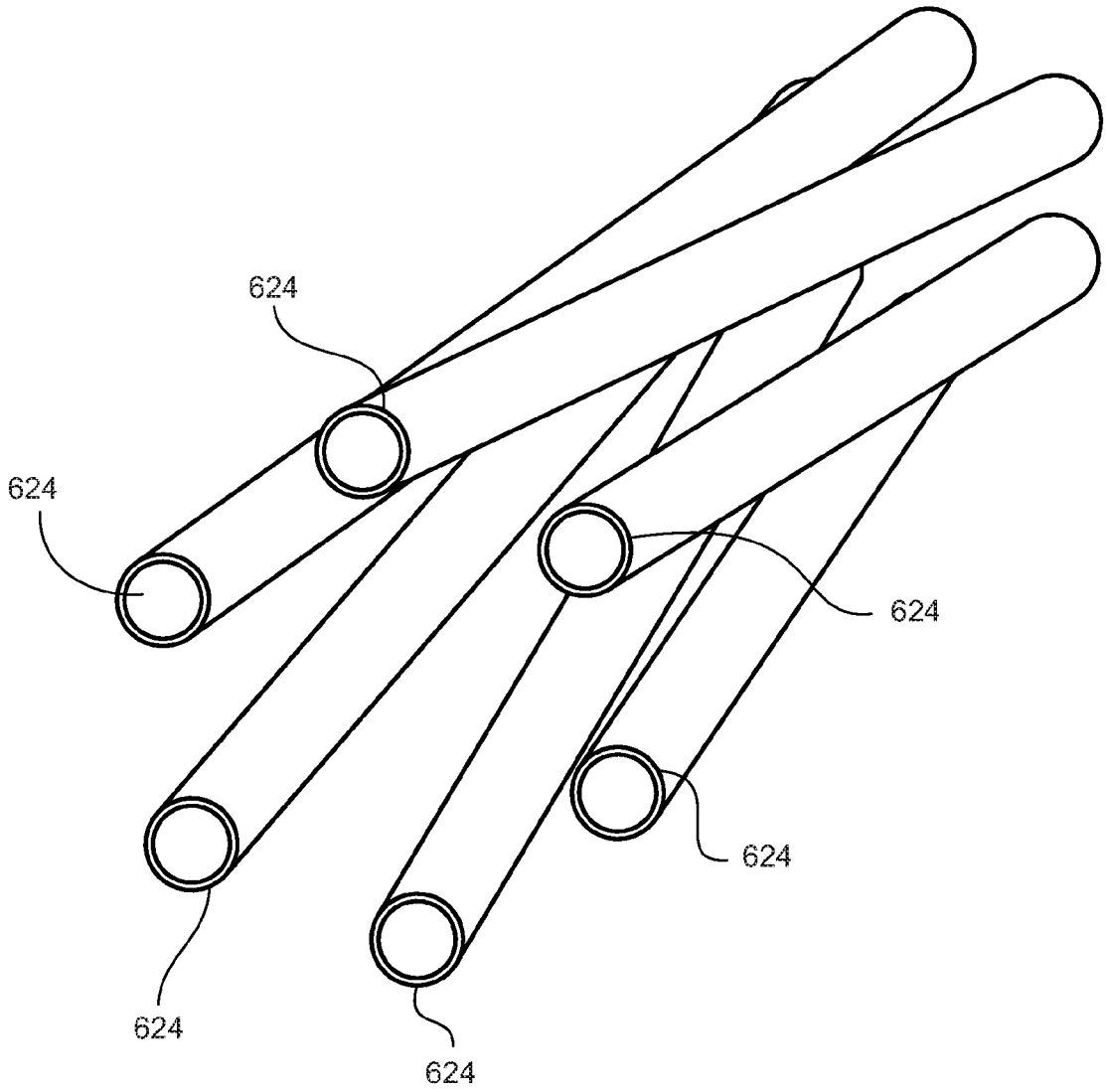
FIG. 6B is a perspective view of the set of first electrodes illustrated in FIG. 6A.

FIGS. 6A and 6B illustrate another example of ion guide electrodes having a hyperbolic configuration along the guide axis. Specifically, FIG. 6A is an end view (in the transverse plane) of a set of first electrodes 624 at the ion entrance end, and FIG. 6B is a perspective view of the set of first electrodes 624. Again, a hexapole arrangement is illustrated by example only. In the present embodiment, the first electrodes 624 are shaped as straight cylindrical rods. However, the first electrodes 624 are arranged and oriented relative to the guide axis such that they inscribe a guide volume having a hyperbolic radial boundary swept about the guide axis, such as illustrated in FIGS. 5A and 5B. In particular, the first electrodes 624 are oriented at a twist angle about the guide axis, as shown in FIGS. 6A and 6B. Hence, the first electrodes 624 are "twisted" around the guide axis, yet remain as straight cylindrical rods, with the result being that they exhibit a hyperbolic profile along the guide axis. In some embodiments, the twist angle may be in a range from a few degrees to almost 180 degrees. Different twist angles provide different hyperbolic curvatures. With proper selection of this twist angle and the entrance and exit diameters, the resulting hyperbolic geometry can provide a converging section followed by a (nearly) straight section, reproducing the general effect of a configuration such as, for example, described above and illustrated in FIG. 4. Stated in another way, the straight rods (first electrodes 624, or both first electrodes 624 and second electrodes 660) are oriented in a way so as to lie on the surface of a hyperboloid of revolution. The orientation results in changing the surface on which the straight rods lie from the special case of a cone, in which the locations of the two axial ends of each rod are at the same rotational angle, to a hyperboloid in which the location of one of the rod ends is "twisted" with respect to the other end.

The twisted configuration of the first electrodes 624 may offer some unique advantages. For example, the twisted configuration may allow the first electrodes 624 to be grouped closer together as compared to known ion guide configuration. This allows the first electrodes 624 to pass through a comparatively smaller aperture between two vacuum stages, thereby enabling more limited gas conductance and a greater pressure drop between the vacuum stages. As another example, the twisted configuration may impart a swirling effect on the overall gas flow in the ion guide, which may promote energy dissipation in the gas molecules.

Conceptually, the straight first electrodes 624 may initially be arranged to form a straight cone section analogous to a conventional converging multipole ion guide. Once laid out in this way, a fixture holding one end of the first electrodes 624 is then twisted by some angle ranging from a few degrees up to almost 180 degrees, while preserving the straight cylindrical geometry of the first electrodes 624. That is, the twisting of the first electrodes 624 is done without actually bending or twisting the material of the first electrodes 624. This has the effect of forming an enclosed guide volume with the shape of a hyperbola rotated about the central axis.

FIG. 6A also illustrates a set of second electrodes 660. In the illustrated embodiment, the second electrodes 660 are elongated rods similar to the first electrodes 624, and the number of second electrodes 660 provided is the same as the first electrodes 624 (six in the present example). The second electrodes 660 may be positioned such that they are interleaved outside of (from a radial perspective) and between (from the perspective of angular position in the transverse plane relative to the guide axis) the first electrodes 624. Alternatively, the second electrodes 660 may be configured according to any of the other embodiments disclosed herein. As illustrated, the second electrodes 660 may also have hyperbolic configuration similar to the first electrodes 624. A first RF voltage, second RF voltage, and axial DC gradients may be applied to the first electrodes 624 and second electrodes 660 as described above.

It will appreciated that embodiments of the present disclosure encompass ion guides in which only the first electrodes are provided, according to any of the configurations described herein such as those illustrated in FIGS. 1 to 6B. Such embodiments may be implemented without the provision of a second RF voltage or second electrode(s).

In other embodiments, dual-field ion guides (comprising a first RF generator and second RF generator) may be provided in which the first electrodes do not include a converging section. For example, the first electrodes may be arranged in a straight cylindrical geometry. In such embodiments, the first electrodes may include an entrance section defined by where the second RF field is applied, followed by an exit section. Consequently, the RF confining field generated by the ion guide may transition from a composite first RF field (Nth order)/second RF field (2Nth order) in the entrance section to a first RF field (Nth order) in the exit section. This configuration may produce a desirable beam compression ratio even without the converging geometry. In such embodiments, the second electrode(s) may also have a straight cylindrical geometry, or alternatively may have a converging or diverging geometry, as desired to provide different effects on the ion confinement.

Figure 7A:
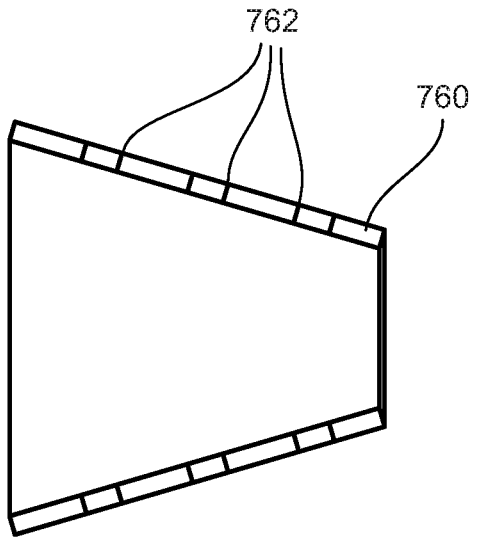
FIG. 7A is a cross-sectional side view of an example of a second electrode configured as a conical solid wall according to some embodiments.
Figure 7B:
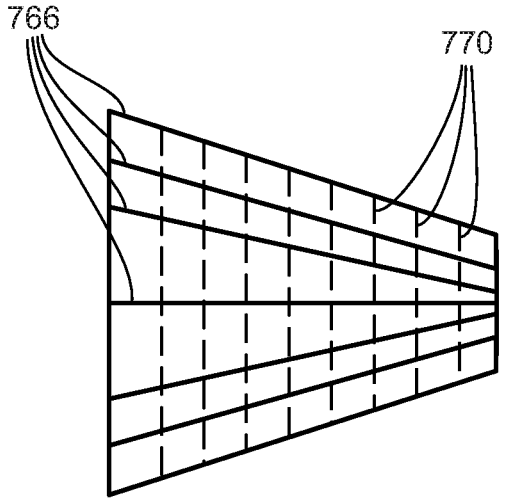
FIG. 7B is a cross-sectional side view of an example of a plurality of second electrodes configured as a conical grid or mesh according to some embodiments.
Figure 7C:
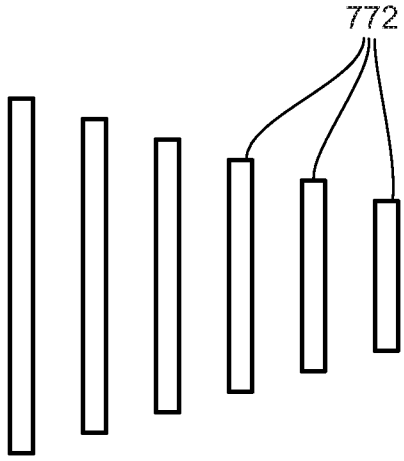
FIG. 7C is a cross-sectional side view of an example of a plurality of axially spaced, ring-shaped second electrodes having successively reduced diameters in the direction of ion process flow according to some embodiments.

FIGS. 7A, 7B, and 7C illustrate other examples of configurations for the second electrode. FIG. 7A is a cross-sectional side view of a second electrode 760 configured as a conical solid wall. In some embodiments, the wall may have one or more through-holes 762 to facilitate gas flow. FIG. 7B is a cross-sectional side view of a plurality of second electrodes 766 configured as a conical grid, in which the second electrodes 766 are elongated along and converge toward the guide axis. In some embodiments, a plurality of axially spaced, ring-shaped second electrodes 770 are also provided. These second electrodes 770 have successively reduced diameters in the direction of ion process flow. The combination of second electrodes 766 and 770 thus form a conical mesh. FIG. 7C is a cross-sectional side view of a plurality of axially spaced, ring-shaped second electrodes 772 having successively reduced diameters in the direction of ion process flow. Each second electrode 772 may be individually addressable by an RF source and DC source as desired. In another embodiment (not specifically shown), the second electrodes may be elongated and circumferentially arranged about the guide axis (similar to examples of the first electrodes described above), and each second electrode is segmented into a plurality of segments spaced from each other along a direction in which the second electrode is elongated. In this case, each second electrode may be individually addressable by an RF source and DC source as desired. In any of the foregoing embodiments of the second electrode(s), the second electrode(s) may have a cylindrical geometry instead of the illustrated conical or converging geometry, or alternatively may have a diverging geometry, as desired to provide different effects on the ion confinement.

EXEMPLARY EMBODIMENTS

Exemplary embodiments provided in accordance with the presently disclosed subject matter include, but are not limited to, the following:

1. An ion guide, comprising: an entrance end; an exit end at a distance from the entrance end along a guide axis; a first RF field generator configured for generating a first RF field of Nth order where N is an integer equal to or greater than 2, the first RF field generator comprising a plurality of first electrodes elongated along the guide axis and circumferentially spaced about the guide axis, wherein the first electrodes surround a guide volume between the entrance end and the exit end; and a second RF field generator configured for generating a second RF field of 2Nth order superimposed on the first RF field and penetrating between the first electrodes, the second RF field generator comprising one or more second electrodes.

2. The ion guide of embodiment 1, wherein the first electrodes comprise an entrance section extending from the entrance end and converging toward the guide axis, and an exit section extending from the entrance section to the exit end.

3. The ion guide of embodiment 2, wherein the second electrodes surround the first electrodes along the entrance section.

4. The ion guide of embodiment 2 or 3, wherein the first electrodes define a straight cylindrical volume along at least a portion of the exit section.

5. The ion guide of any of embodiments 2 to 4, wherein the first electrodes are bent such that the first electrodes converge toward each other in the entrance section and transition to a straight cylindrical arrangement in the exit section.

6. The ion guide of any of the preceding embodiments, wherein the first RF field generator is configured for generating an axial DC gradient along a length of the ion guide.

7. The ion guide of any of the preceding embodiments, comprising an axial DC gradient generating configuration selected from the group consisting of: each first electrode comprises an insulating element and a resistive element surrounding the insulating element; each second electrode comprises an insulating element and a resistive element surrounding the insulating element; and both of the foregoing.

The ion guide of embodiment 7, comprising a DC voltage source communicating with the resistive elements and configured for generating an axial DC gradient along at least a portion of the length of the first electrodes or the second electrodes.8.

9. The ion guide of any of the preceding embodiments, wherein the plurality of first electrodes comprises a hyperbolic configuration such that the guide volume has a hyperbolic radial boundary swept about the guide axis.

10. The ion guide of embodiment 9, wherein the hyperbolic configuration of the first electrodes is such that the guide volume has a minimum radius from the guide axis at an axial point closer to the exit end than to the entrance end.

11. The ion guide of embodiment 9 or 10, wherein the hyperbolic configuration extends from the entrance end to the exit end.

12. The ion guide of any of embodiments 9 to 11, wherein each of the first electrodes is shaped as a straight cylindrical rod.

13. The ion guide of any of embodiments 9 to 12, wherein the first electrodes are oriented at a twist angle about the guide axis.

14. The ion guide of any of embodiments 9 to 11, wherein each of the first electrodes has a hyperbolic curvature.

15. The ion guide of any of embodiments 9 to 14, wherein the one or more second electrodes have a hyperbolic configuration.

16. The ion guide of any of the preceding embodiments, wherein the one or more second electrodes have a configuration selected from the group consisting of: a single second electrode comprising a wall having a conical or cylindrical geometry; a single second electrode comprising a wall having a conical or cylindrical geometry, and having one or more through-holes in the wall; a grid having a conical or cylindrical geometry, and comprising a plurality of second electrodes elongated along the guide axis; a plurality of axially spaced, ring-shaped second electrodes having constant diameters or successively reduced diameters; a mesh having a conical or cylindrical geometry, and comprising a plurality of second electrodes elongated along the guide axis and a plurality of axially spaced, ring-shaped second electrodes; a plurality of second electrodes elongated along the guide axis and circumferentially spaced about the guide axis, and circumscribing a volume having a conical, cylindrical, or hyperbolic geometry; a plurality of second electrodes elongated along the guide axis and circumferentially spaced about the guide axis, and circumscribing a volume having a conical or cylindrical geometry, wherein each second electrode is segmented into a plurality of segments spaced from each other along a direction in which the second electrode is elongated; a plurality of second electrodes passing between respective adjacent pairs of the first electrodes; and the one or more second electrodes surround the first electrodes.

17. The ion guide of any of the preceding embodiments, wherein the first electrodes are located at a first radius from the guide axis, the second electrodes are located at a second radius from the guide axis, the second electrodes have an upstream end at the entrance end and an axially opposing downstream end, and the second radius differs from the first radius by an offset selected from the group consisting of: an offset that remains constant along the guide axis; an offset that varies along the guide axis; and an offset that is smaller at the downstream end than at the upstream end.

18. The ion guide of any of the preceding embodiments, comprising an RF voltage source configured for applying a first RF voltage to the first electrodes at a first frequency, and a second RF voltage to the one or more second electrodes at a second frequency lower than the first frequency.

19. The ion guide of embodiment 18, wherein the second frequency is in a range of 50% or less of the first frequency.

20. The ion guide of any of the preceding embodiments, comprising an RF voltage source configured for applying the first RF voltage at a first phase to a first group of the first electrodes, and applying the first RF voltage at a second phase to a second group of the first electrodes, wherein each first electrode of the first group is adjacent to at least one first electrode of the second group, and wherein the second phase is shifted 180 degrees from the first phase.

21. The ion guide of any of the preceding embodiments, comprising an RF voltage source configured for applying a single-phase RF voltage to the one or more second electrodes.

22. The ion guide of any of the preceding embodiments, comprising a plurality of vacuum stages, wherein the first electrodes extend through at least two of the vacuum stages.

23. The ion guide of embodiment 22, comprising a wall between the at least two vacuum stages, the wall having an aperture on the guide axis and positioned closer to the exit end than to the entrance end.

24. The ion guide of embodiment 23, wherein the plurality of first electrodes comprises a hyperbolic configuration such that the guide volume has a hyperbolic radial boundary swept about the guide axis, and the guide volume has a minimum radius from the guide axis at or proximate to the wall.

25. An ion guide, comprising: an entrance end; an exit end at a distance from the entrance end along a guide axis; and a plurality of electrodes extending from the entrance end to the exit end and circumferentially spaced about the guide axis, the plurality of electrodes comprising a hyperbolic configuration such that the electrodes inscribe a guide volume from the entrance end to the exit end having a hyperbolic radial boundary swept about the guide axis.

26. The ion guide of embodiment 25, wherein each of the electrodes is shaped as a straight cylinder.

27. The ion guide of embodiment 25 or 26, wherein the electrodes are oriented at a twist angle about the guide axis.

28. The ion guide of embodiment 25, wherein each of the electrodes has a hyperbolic curvature.

29. The ion guide of any of embodiments 25 to 28, wherein the electrodes extending from the entrance end to the exit end are first electrodes, and further comprising one or more second electrodes.

30. The ion guide of embodiment 29, wherein the one or more second electrodes have a configuration selected from the group consisting of: a single second electrode comprising a wall having a conical or cylindrical geometry; a single second electrode comprising a wall having a conical or cylindrical geometry, and having one or more through-holes in the wall; a grid having a conical or cylindrical geometry, and comprising a plurality of second electrodes elongated along the guide axis; a plurality of axially spaced, ring-shaped second electrodes having constant diameters or successively reduced diameters; a mesh having a conical or cylindrical geometry, and comprising a plurality of second electrodes elongated along the guide axis and a plurality of axially spaced, ring-shaped second electrodes; a plurality of second electrodes elongated along the guide axis and circumferentially spaced about the guide axis, and circumscribing a volume having a conical, cylindrical, or hyperbolic geometry; a plurality of second electrodes elongated along the guide axis and circumferentially spaced about the guide axis, and circumscribing a volume having a conical or cylindrical geometry, wherein each second electrode is segmented into a plurality of segments spaced from each other along a direction in which the second electrode is elongated; a plurality of second electrodes passing between respective adjacent pairs of the first electrodes; the one or more second electrodes surround the first electrodes; and the one or more second electrodes surround the first electrodes along a region at which the hyperbolic radial boundary is converging.

31. The ion guide of embodiment 29 or 30, wherein the first electrodes are configured for generating a first RF field of Nth order where N is an integer equal to or greater than 2, and the one or more second electrodes are configured for generating a second RF field of 2Nth order superimposed on the first RF field and penetrating between the first electrodes.

32. An ion guide, comprising: an entrance end; an exit end at a distance from the entrance end along a guide axis; and a plurality of electrodes extending from the entrance end to the exit end and circumferentially spaced about the guide axis, the plurality of electrodes oriented at a twist angle about the guide axis wherein the electrodes inscribe a guide volume from the entrance end to the exit end having a hyperbolic radial boundary swept about the guide axis.

33. The ion guide of embodiment 32, wherein each of the electrodes is shaped as a straight cylinder.

34. The ion guide of embodiment 32 or 33, wherein the electrodes extending from the entrance end to the exit end are first electrodes, and further comprising one or more second electrodes.

35. The ion guide of embodiment 34, wherein the one or more second electrodes have a configuration selected from the group consisting of: a single second electrode comprising a wall having a conical or cylindrical geometry; a single second electrode comprising a wall having a conical or cylindrical geometry, and having one or more through-holes in the wall; a grid having a conical or cylindrical geometry, and comprising a plurality of second electrodes elongated along the guide axis; a plurality of axially spaced, ring-shaped second electrodes having constant diameters or successively reduced diameters; a mesh having a conical or cylindrical geometry, and comprising a plurality of second electrodes elongated along the guide axis and a plurality of axially spaced, ring-shaped second electrodes; a plurality of second electrodes elongated along the guide axis and circumferentially spaced about the guide axis, and circumscribing a volume having a conical, cylindrical, or hyperbolic geometry; a plurality of second electrodes elongated along the guide axis and circumferentially spaced about the guide axis, and circumscribing a volume having a conical or cylindrical geometry, wherein each second electrode is segmented into a plurality of segments spaced from each other along a direction in which the second electrode is elongated; a plurality of second electrodes passing between respective adjacent pairs of the first electrodes; the one or more second electrodes surround the first electrodes; and the one or more second electrodes surround the first electrodes along a region at which the hyperbolic radial boundary is converging.

36. The ion guide of embodiment 34 or 35, wherein the first electrodes are configured for generating a first RF field of Nth order where N is an integer equal to or greater than 2, and the one or more second electrodes are configured for generating a second RF field of 2Nth order superimposed on the first RF field and penetrating between the first electrodes.

37. A method for concentrating an ion beam, the method comprising: transmitting the ion beam through an ion guide comprising an entrance end, an exit end at a distance from the entrance end along a guide axis, and a plurality of multipole electrodes surrounding a guide volume between the entrance end and the exit end; while transmitting the ion beam, applying a first RF field of Nth order to the ion beam, where N is an integer equal to or greater than 2; and applying a second RF field of 2Nth order to the ion beam, wherein the second RF field is superimposed on the first RF field and penetrates between the multipole electrodes.

38. The method of embodiment 37, wherein the first electrodes comprise an entrance section extending from the entrance end and converging toward the guide axis, and an exit section extending from the entrance section to the exit end, and the second RF field is superimposed on the first RF field in the entrance section.

39. The method of embodiment 37 or 38, wherein the plurality of multipole electrodes comprises a hyperbolic configuration such that the guide volume has a hyperbolic radial boundary swept about the guide axis.

40. The method of any of embodiments 37 to 39, wherein the multipole electrodes are first electrodes, applying the first RF field comprises applying a first RF voltage to the first electrodes, and applying the second RF field comprises applying a second RF voltage to one or more second electrodes.

41. A method for concentrating an ion beam, the method comprising: transmitting the ion beam through an ion guide comprising an entrance end, an exit end at a distance from the entrance end along a guide axis, and a plurality of electrodes extending from the entrance end to the exit end and circumferentially spaced about the guide axis, the plurality of electrodes comprising a hyperbolic configuration such that the electrodes inscribe a guide volume from the entrance end to the exit end having a hyperbolic radial boundary swept about the guide axis; and while transmitting the ion beam, applying a radial RF confining field to the ion beam.

42. The method of embodiment 41, wherein the radial RF confining field is a first RF field of Nth order where N is an integer equal to or greater than 2, and further comprising applying a second RF field of 2Nth order such that the second RF field is superimposed on the first RF field in a converging section of the hyperbolic configuration and penetrates between the electrodes.

43. The method of embodiment 41 or 42, wherein the electrodes comprising the hyperbolic configuration are first electrodes, and second RF field is applied to one or more second electrodes.

44. A method for concentrating an ion beam, the method comprising: transmitting the ion beam through an ion guide comprising an entrance end, an exit end at a distance from the entrance end along a guide axis, and a plurality of electrodes extending from the entrance end to the exit end and circumferentially spaced about the guide axis, the plurality of electrodes oriented at a twist angle about the guide axis wherein the electrodes inscribe a guide volume from the entrance end to the exit end having a hyperbolic radial boundary swept about the guide axis; and while transmitting the ion beam, applying a radial RF confining field to the ion beam.

45. The method of embodiment 44, wherein the radial RF confining field is a first RF field of Nth order where N is an integer equal to or greater than 2, and further comprising applying a second RF field of 2Nth order such that the second RF field is superimposed on the first RF field in a converging section of the hyperbolic radial boundary and penetrates between the electrodes.

46. The method of embodiment 44 or 45, wherein the electrodes oriented at the twist angle are first electrodes, and second RF field is applied to one or more second electrodes.

It will be understood that the term "in signal communication" as used herein means that two or more systems, devices, components, modules, or sub-modules are capable of communicating with each other via signals that travel over some type of signal path. The signals may be communication, power, data, or energy signals, which may communicate information, power, or energy from a first system, device, component, module, or sub-module to a second system, device, component, module, or sub-module along a signal path between the first and second system, device, component, module, or sub-module. The signal paths may include physical, electrical, magnetic, electromagnetic, electrochemical, optical, wired, or wireless connections. The signal paths may also include additional systems, devices, components, modules, or sub-modules between the first and second system, device, component, module, or sub-module.

More generally, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. An ion guide, comprising:

an entrance end;

an exit end at a distance from the entrance end along a guide axis;

a first RF field generator configured for generating a first RF field of Nth order where N is an integer equal to or greater than 2, the first RF field generator comprising a plurality of first electrodes elongated along the guide axis and circumferentially spaced about the guide axis, wherein the first electrodes surround a guide volume between the entrance end and the exit end; and a second RF field generator configured for generating a second RF field of 2Nth order superimposed on the first RF field and penetrating between the first electrodes, the second RF field generator comprising one or more second electrodes.

2. The ion guide of claim 1, wherein the first electrodes comprise an entrance section extending from the entrance end and converging toward the guide axis, and an exit section extending from the entrance section to the exit end, and further comprising a configuration selected from the group consisting of:

the second electrodes surround the first electrodes along the entrance section;

the first electrodes define a straight cylindrical volume along at least a portion of the exit section;

the first electrodes are bent such that the first electrodes converge toward each other in the entrance section and transition to a straight cylindrical arrangement in the exit section; and a combination of two or more of the foregoing.

3. The ion guide of claim 1, wherein the first RF field generator is configured for generating an axial DC gradient along a length of the ion guide.

4. The ion guide of claim 1, wherein the plurality of first electrodes comprises a hyperbolic configuration such that the guide volume has a hyperbolic radial boundary swept about the guide axis.

5. The ion guide of claim 4, wherein the hyperbolic configuration of the first electrodes is such that the guide volume has a minimum radius from the guide axis at an axial point closer to the exit end than to the entrance end.

6. The ion guide of claim 4, wherein the hyperbolic configuration extends from the entrance end to the exit end.

7. The ion guide of claim 4, wherein each of the first electrodes is shaped as a straight cylindrical rod.

8. The ion guide of claim 4, wherein the first electrodes are oriented at a twist angle about the guide axis.

9. The ion guide of claim 4, wherein each of the first electrodes has a hyperbolic curvature.

10. The ion guide of claim 4, wherein the one or more second electrodes have a hyperbolic configuration.

11. The ion guide of claim 1, wherein the one or more second electrodes have a configuration selected from the group consisting of:

a single second electrode comprising a wall having a conical or cylindrical geometry;

a single second electrode comprising a wall having a conical or cylindrical geometry, and having one or more through-holes in the wall;

a grid having a conical or cylindrical geometry, and comprising a plurality of second electrodes elongated along the guide axis;

a plurality of axially spaced, ring-shaped second electrodes having constant diameters or successively reduced diameters;

a mesh having a conical or cylindrical geometry, and comprising a plurality of second electrodes elongated along the guide axis and a plurality of axially spaced, ring-shaped second electrodes;

a plurality of second electrodes elongated along the guide axis and circumferentially spaced about the guide axis, and circumscribing a volume having a conical, cylindrical, or hyperbolic geometry;

a plurality of second electrodes elongated along the guide axis and circumferentially spaced about the guide axis, and circumscribing a volume having a conical or cylindrical geometry, wherein each second electrode is segmented into a plurality of segments spaced from each other along a direction in which the second electrode is elongated;

a plurality of second electrodes passing between respective adjacent pairs of the first electrodes; and the one or more second electrodes surround the first electrodes.

12. The ion guide of claim 1, comprising an RF voltage source configured for applying a first RF voltage to the first electrodes at a first frequency, and a second RF voltage to the one or more second electrodes at a second frequency lower than the first frequency.

13. The ion guide of claim 1, comprising an RF voltage source configured for applying a single-phase RF voltage to the one or more second electrodes.

14. The ion guide of claim 1, comprising a plurality of vacuum stages, wherein the first electrodes extend through at least two of the vacuum stages.

15. An ion guide, comprising:

an entrance end;

an exit end at a distance from the entrance end along a guide axis; and a plurality of electrodes extending from the entrance end to the exit end, the electrodes circumferentially spaced about the guide axis and positioned at a radial distance from the guide axis in a transverse plane orthogonal to the guide axis, wherein the plurality of electrodes comprises a hyperbolic configuration such that the electrodes inscribe a guide volume from the entrance end to the exit end having a hyperbolic radial boundary defined by spatial coordinates along the guide axis and along a radial axis in a length-wise plane orthogonal to the transverse plane.

16. The ion guide of claim 15, wherein each of the electrodes is shaped as a straight cylinder.

17. The ion guide of claim 15, wherein the electrodes are oriented at a twist angle about the guide axis.

18. The ion guide of claim 15, wherein each of the electrodes has a hyperbolic curvature.

19. The ion guide of claim 15, wherein the electrodes extending from the entrance end to the exit end are first electrodes, and further comprising one or more second electrodes.

20. The ion guide of claim 19, wherein the one or more second electrodes have a configuration selected from the group consisting of:

a single second electrode comprising a wall having a conical or cylindrical geometry;

a single second electrode comprising a wall having a conical or cylindrical geometry, and having one or more through-holes in the wall;

a grid having a conical or cylindrical geometry, and comprising a plurality of second electrodes elongated along the guide axis;

a plurality of axially spaced, ring-shaped second electrodes having constant diameters or successively reduced diameters;

a mesh having a conical or cylindrical geometry, and comprising a plurality of second electrodes elongated along the guide axis and a plurality of axially spaced, ring-shaped second electrodes;

a plurality of second electrodes elongated along the guide axis and circumferentially spaced about the guide axis, and circumscribing a volume having a conical, cylindrical, or hyperbolic geometry;

a plurality of second electrodes elongated along the guide axis and circumferentially spaced about the guide axis, and circumscribing a volume having a conical or cylindrical geometry, wherein each second electrode is segmented into a plurality of segments spaced from each other along a direction in which the second electrode is elongated;

a plurality of second electrodes passing between respective adjacent pairs of the first electrodes;

the one or more second electrodes surround the first electrodes; and the one or more second electrodes surround the first electrodes along a region at which the hyperbolic radial boundary is converging.

* * * * *